US009267291B1

(12) United States Patent
Ramsey et al.

(10) Patent No.: US 9,267,291 B1
(45) Date of Patent: Feb. 23, 2016

(54) AIR BLOWER DEVICE FOR CLEANING A RAIN GUTTER AND OTHER ELEVATED SURFACES

(71) Applicants: Mark J. Ramsey, Omaha, NE (US); Mark C. Ramsey, Omaha, NE (US)

(72) Inventors: Mark J. Ramsey, Omaha, NE (US); Mark C. Ramsey, Omaha, NE (US)

( * ) Notice: Subject to any disclaimer, the term of this patent is extended or adjusted under 35 U.S.C. 154(b) by 0 days.

(21) Appl. No.: 14/524,544

(22) Filed: Oct. 27, 2014

(51) Int. Cl.

| | |
|---|---|
| ***A47L 5/14*** | (2006.01) |
| ***E04D 13/076*** | (2006.01) |
| *A47L 5/24* | (2006.01) |
| *A47L 9/32* | (2006.01) |
| *A47L 5/08* | (2006.01) |

(52) U.S. Cl.
CPC ..... *E04D 13/0765* (2013.01); *A47L 5/08* (2013.01); *A47L 5/14* (2013.01); *A47L 5/24* (2013.01); *A47L 9/322* (2013.01)

(58) Field of Classification Search
CPC ..... A47L 5/14; A47L 5/24; A47L 9/02; A47L 9/08; A47L 9/322; E04D 13/0765
USPC ..... 15/327.5, 345, 405
IPC ..... A47L 5/14
See application file for complete search history.

(56) References Cited

U.S. PATENT DOCUMENTS

| | | | | |
|---|---|---|---|---|
| D130,959 | S * | 12/1941 | Kirby | D32/30 |
| 4,402,106 | A | 9/1983 | Mattson | |
| 5,535,479 | A | 7/1996 | Pink et al. | |
| 5,894,630 | A * | 4/1999 | Bitner | A47L 5/14 15/330 |
| 8,024,995 | B2 | 9/2011 | Dayton et al. | |
| 8,510,910 | B1 | 8/2013 | Ramsey | |
| 2001/0042284 | A1 | 11/2001 | Gutry | |
| 2004/0143931 | A1 | 7/2004 | Dennis | |
| 2015/0237808 | A1 * | 8/2015 | Prager | A01G 1/125 15/405 |

* cited by examiner

*Primary Examiner* — David Redding
(74) *Attorney, Agent, or Firm* — Dennis L. Thomte; Thomte Patent Law Office LLC

(57) ABSTRACT

A portable air blower is selectively removably secured to the upper end of a length adjustable extension pole to blow twigs, leaves or other debris from a rain gutter or other elevated structures or surfaces.

8 Claims, 7 Drawing Sheets

AIR BLOWER DEVICE FOR CLEANING A RAIN GUTTER AND OTHER ELEVATED SURFACES

BACKGROUND OF THE INVENTION

1. Field of the Invention

This invention relates to a portable air blower device for cleaning a rain gutter and other elevated surfaces and more particularly an air blower device when is attached to the upper end of a length adjustable extension pole. Even more particularly, this invention relates to an air blower device having a football or an ovoid shape.

2. Description of the Related Art

Many types of air blower devices and mechanical devices have been previously provided for cleaning leaves, twigs and other debris from rain gutters. For example, U.S. Pat. No. 4,402,106 discloses a hand-held air blower which has tubular extension members secured thereto. The major drawback of the device of U.S. Pat. No. 4,402,106 is the requirement that a plurality of extension tubes must be used with those tubes having no other useful purpose. The device of U.S. Pat. No. 4,402,106 also requires the use of an elbow at the upper end of the uppermost extension tube.

The device of Published Patent Application US 2004/0143931 requires the use of a straight extension and a gooseneck extension. There is also the possibility that the velocity of the air passing through the extensions of the three devices described above will be reduced since the air must be blown some distance from the air blower.

An improved rain gutter cleaning device is disclosed in U.S. Pat. No. 8,510,910 issued Aug. 20, 2013 entitled AN AIR BLOWER DEVICE FOR CLEANING A RAIN GUTTER AND OTHER ELEVATED SURFACES. The instant invention represents a further improvement in the art.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An air blower device for cleaning a rain gutter and other elevated devices is disclosed which includes an elongated extension pole having a lower handle and an upper end. An air blower is secured to the upper end of the pole. The air blower is powered by a battery directly affixed thereto so that all of the components of the air blower are positioned at the upper end of the extension pole. In the instant invention, the air blower has an ovoid or football shape with a handle provided at the upper rearward side thereof. The ovoid shape of the air blower enables the air blower to be movably supported upon the upper end of a rain gutter with the ovoid shape enabling the air blower to move over the gutter hangers which support the gutters regardless of whether the hangers are of the bracket type or the spike-and-ferrule type.

Further, the air blower has a selectively rotatable air discharge nozzle at its forward end thereof to enable the air blower to be moved along the gutter in a left-to-right manner or a right-to-left manner. Additionally, the air blower has an on/off push button switch positioned at the upper central portion of the air blower.

The apparatus of this invention may also be used to clean overhead or elevated structures. In the preferred embodiment, the air blower is selectively removably secured to the upper end of the extension pole. In the preferred embodiment, the upper end of the extension pole is threadably secured to the air blower.

It is therefore a principal object of the invention to provide an improved air blower device which may be used to clean twigs, leaves and other debris from a rain gutter or an overhead structure or elevated structure.

A further object of the invention is to provide a device of a type described wherein an air blower is secured to the upper end of an extension pole.

A further object of the invention is to provide a device of the type described which includes a self-contained and battery operated air blower mounted on the upper end of an extension pole for cleaning rain gutters and other elevated surfaces.

A further object of the invention is to provide a device of the type described which has a shape designed to enable the air blower to pass over the hanger brackets of the gutter system.

A further object of the invention is to provide a device of the type described which has a selectively rotatable air discharge nozzle to enable the air blower to be moved in a left-to-right manner or a right-to-left manner with regards to the rain gutter being cleaned.

A further object of the invention is to provide a device of the type described which has a selectively rotatable air discharge nozzle which is selectively rotatable with respect to the forward end of the body of the device.

Yet another object of the invention is to provide a device of the type described which has an on/off push button switch at the upper portion of the device.

Still another object of the invention is to provide a device of the type described which has spaced-apart fins extending outwardly from a selectively rotatable air discharge nozzle whereby the air discharge nozzle may be adjusted without lowering the device from the rain gutter or the like.

A further object of the invention is to provide a device of a type described which is easy and is safe to use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
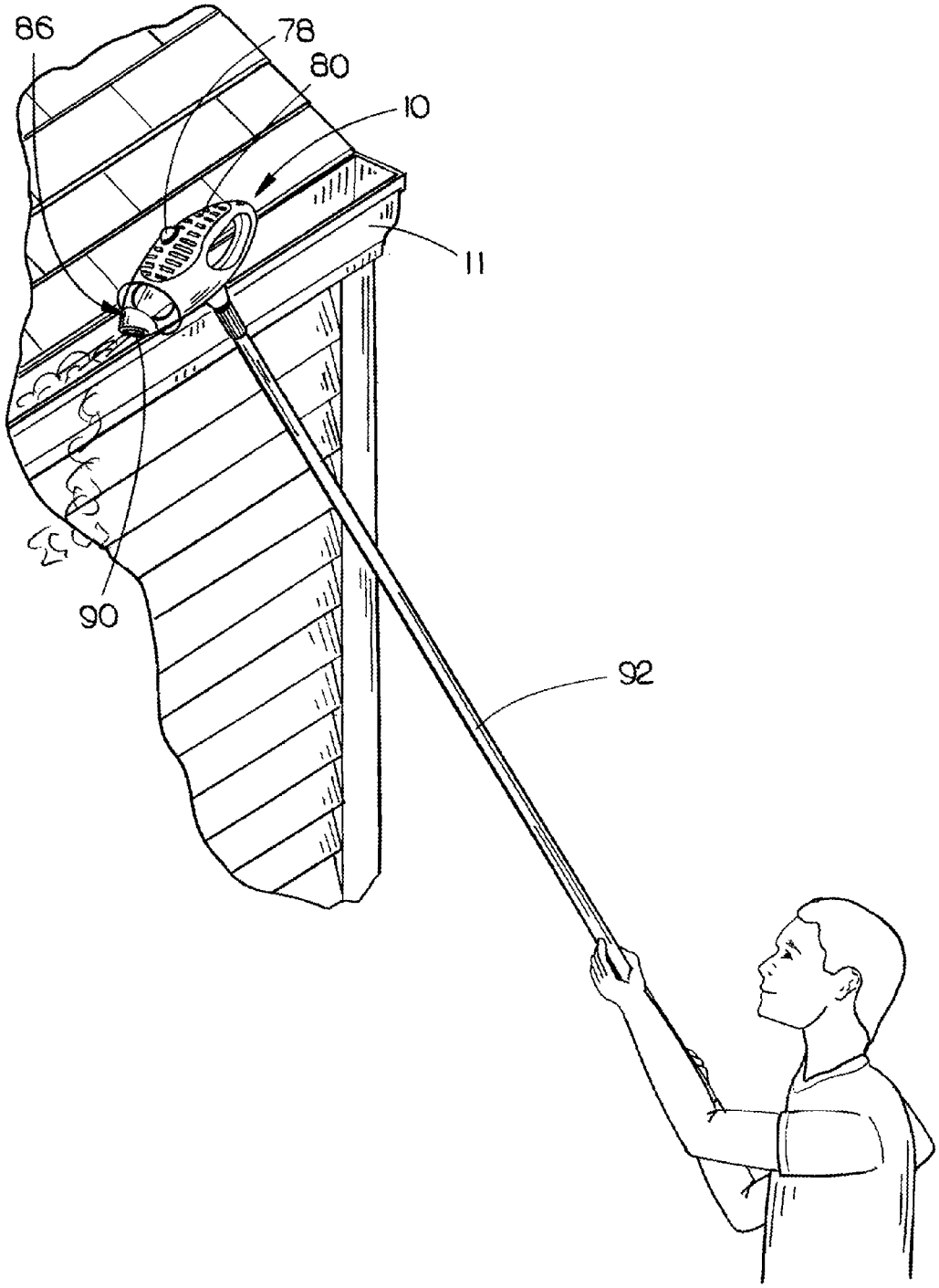
FIG. 1 is a perspective view illustrating the air blower device of this invention being uses to clean a rain gutter.
Figure 2:
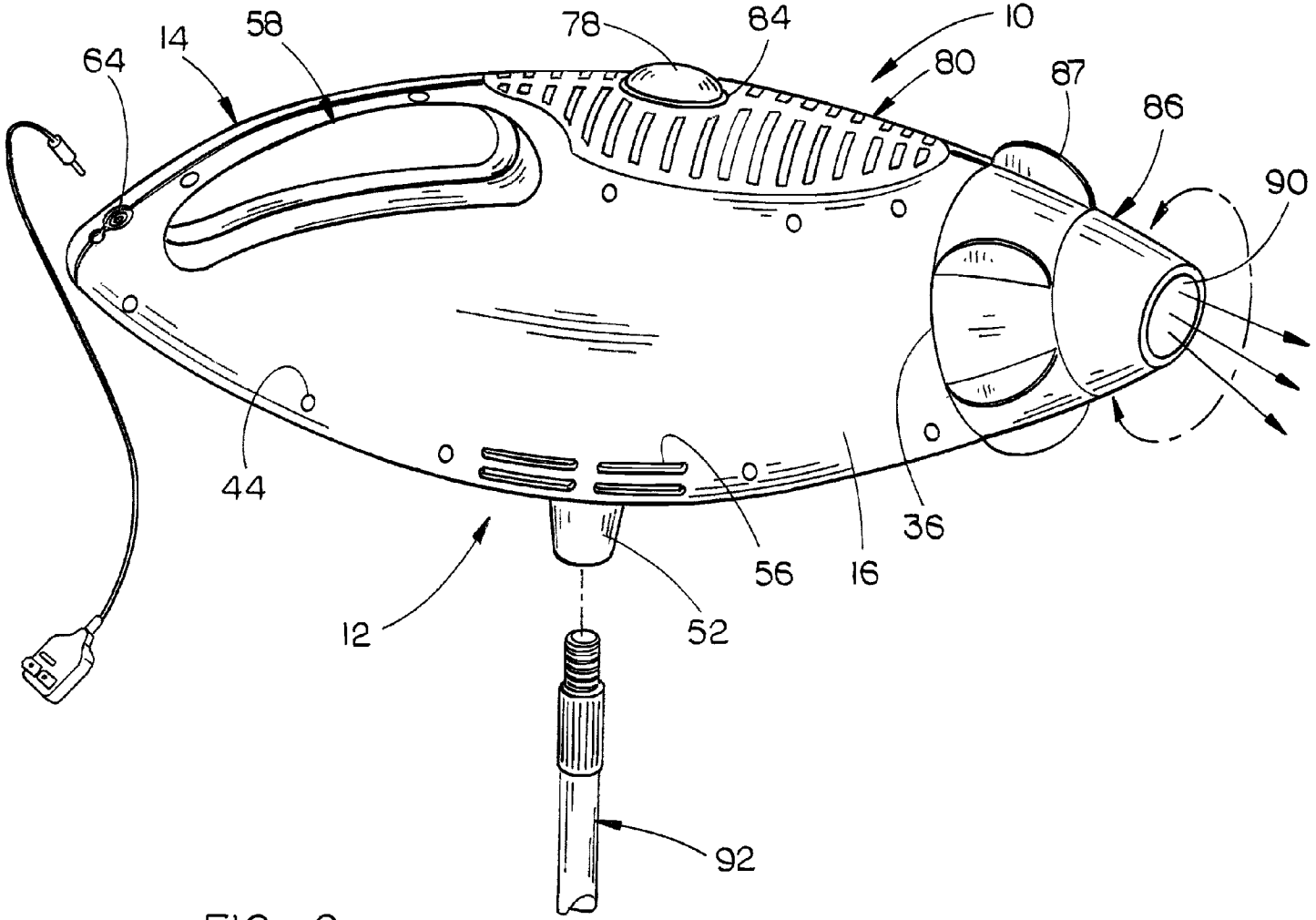
FIG. 2 is a side perspective view of the air blower device of this invention which illustrates how the air flow discharge nozzle may be selectively rotatably adjusted with respect to the body of the device.
Figure 3:
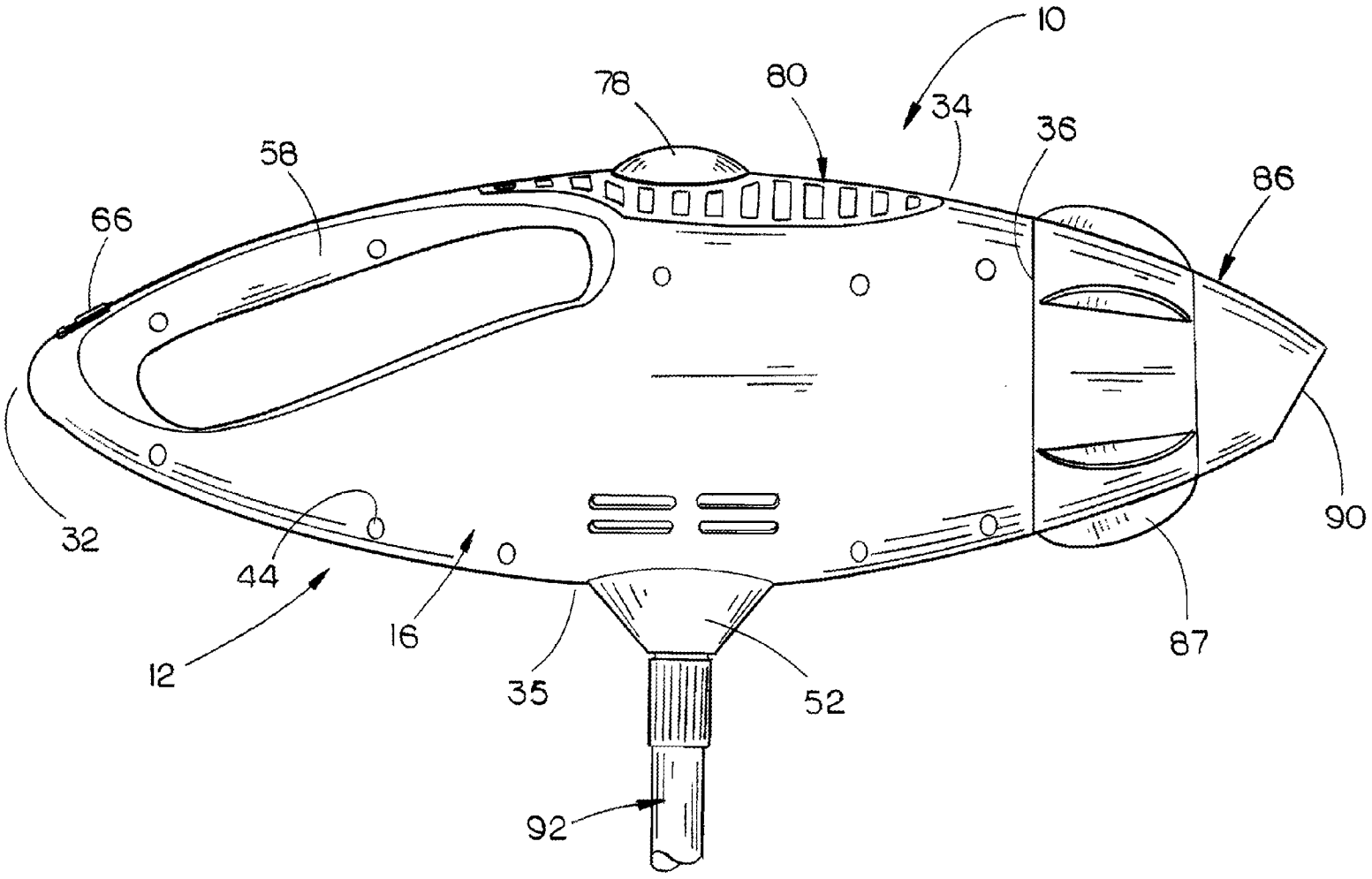
FIG. 3 is a side view of the air blower device of this invention.
Figure 4:
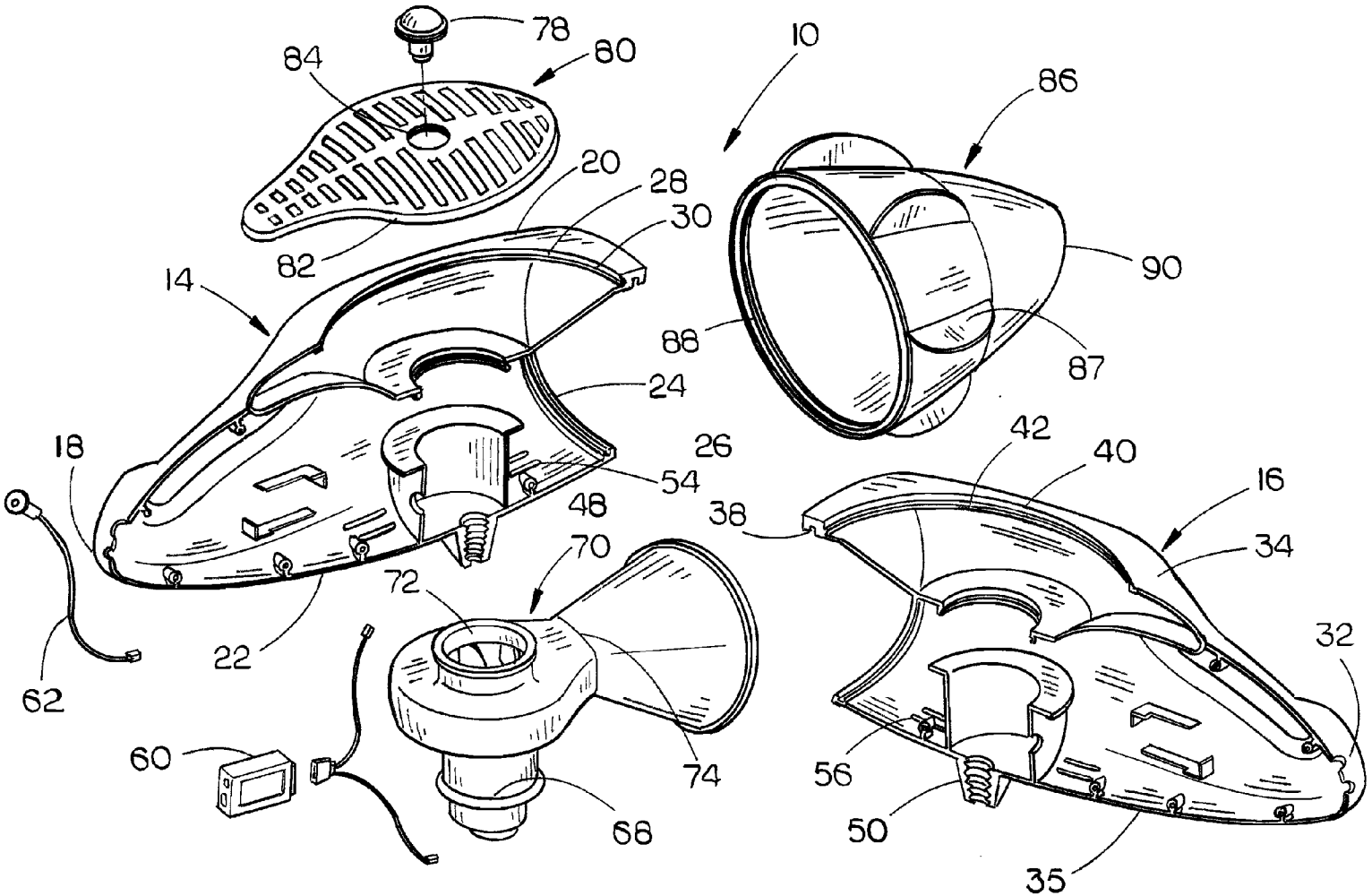
FIG. 4 is an exploded perspective view of the air blower device of this invention.
Figure 5:
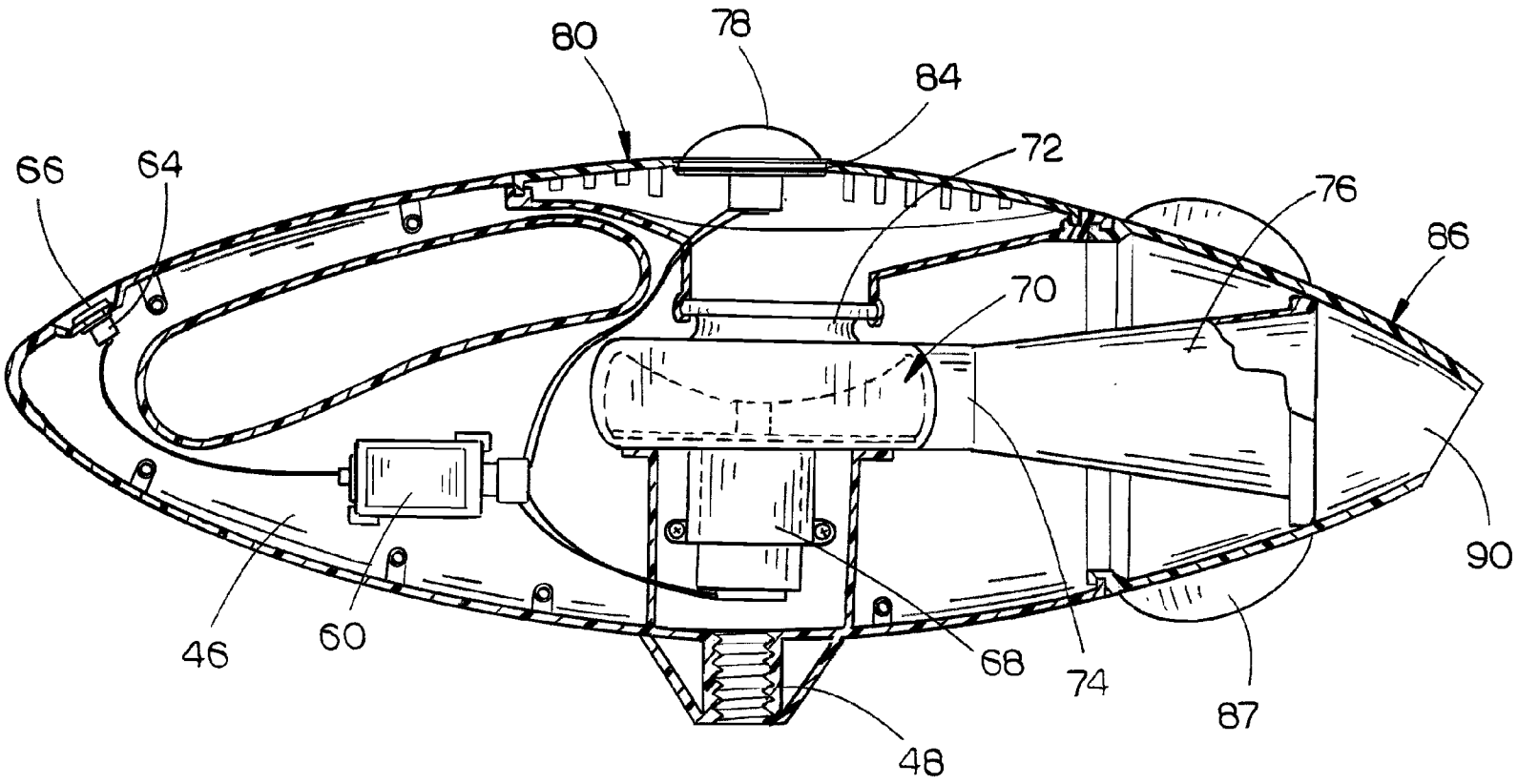
FIG. 5 is a sectional view of the air blower device of this invention.
Figure 6:
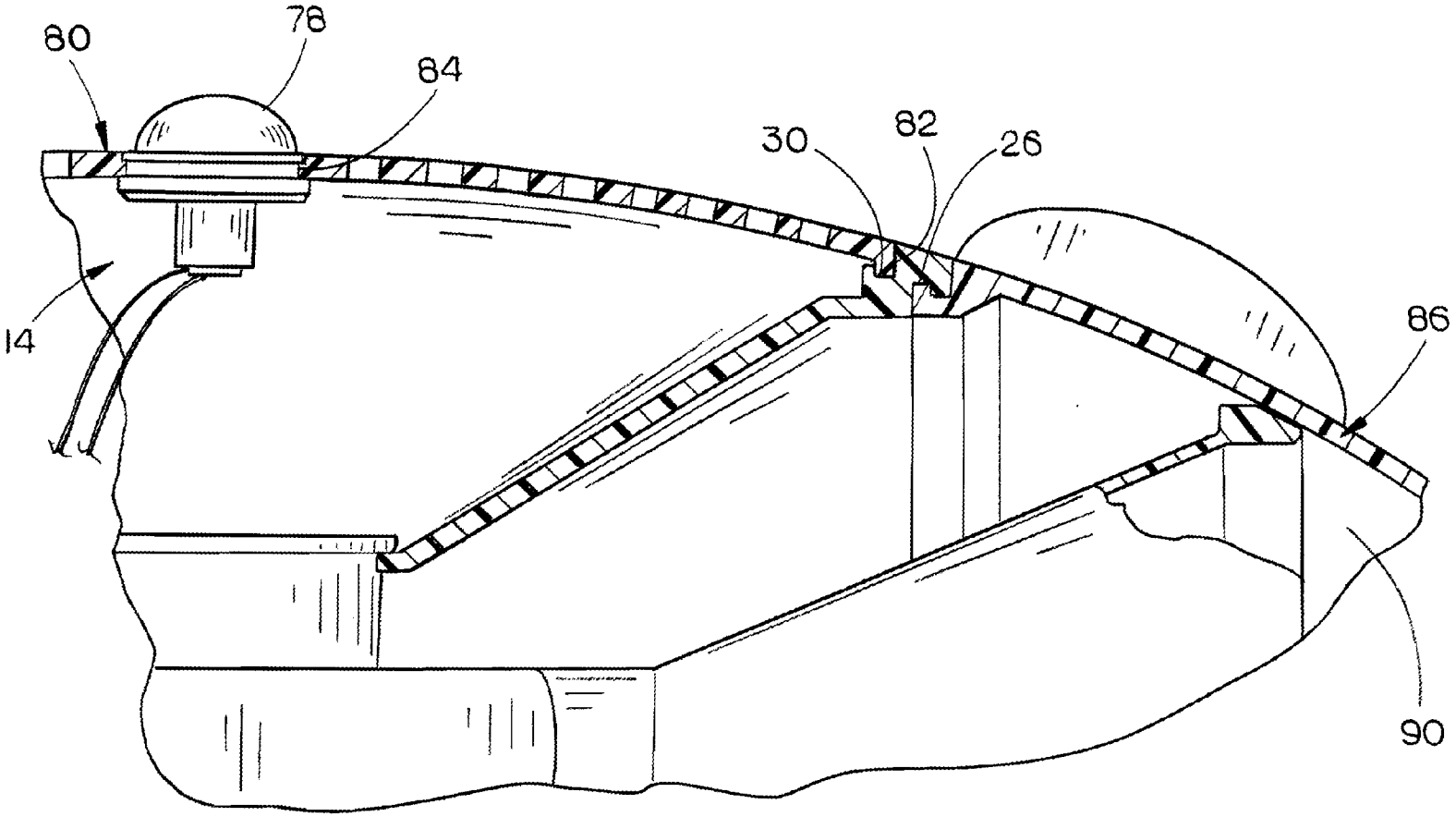
FIG. 6 is a partial sectional view of the air blower device of this invention which illustrates the manner in which the nose cone of the device is rotatable with respect to the body of the device and which illustrates the manner in which the air intake grill is secured to the body of the device.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The air blower cleaning device of this invention is generally designated by the reference numeral 10 and may be used to clean leaves, twigs or other debris from a rain gutter 11 or an elevated surface or structure such as a roof, canopy, screen, etc.

Device 10, when completely assembled, has a modified and enlarged ovoid or football-like configuration. The device 10 may also be described as having a prolate spheroid shape. Device 10 includes a body 12 which includes a first body portion 14 joined to a second body portion 16. First body portion 14 has a generally pointed rearward end 18, an upper end 20, a lower end 22, and a semi-circular forward end 24. As seen, the semi-circular forward end 24 of body portion 14 has a U-shaped channel 26 formed therein. As also seen, the upper end of body portion 14 has an arcuate cut-out portion or recess 28 formed therein. The periphery of cut-out portion 28 has an upwardly presented U-shaped channel 30 formed therein.

The second body portion 16 is a mirror image of body portion 14 and has a generally pointed rearward end 32, an upper end 34, a lower end 35 and a semi-circular forward end 36. As seen, the semi-circular forward end 36 of body portion 16 has a U-shaped channel 38 formed therein. As also seen, the upper end 34 of body portion 16 has an arcuate cut-out portion or recess 40 formed therein. The periphery of cut-out portion 40 has an upwardly presented U-shaped channel 42 formed therein. Body portions 14 and 16 are joined together by screws 44. Body portions 14 and 16 are preferably comprised of a plastic material. When body portions 14 and 16 are secured together, they define an interior compartment 46.

The numeral 48 refers to an internally threaded connector portion which extends downwardly from body portion 14. The numeral 50 refers to an internally threaded connector portion which extends downwardly from body portion 16. When body portions 14 and 16 are joined together, the connector portions 48 and 50 are joined together to form an internally threaded pole connector 52.

Preferably, the first body portion 14 has a plurality of drain openings 54 formed therein at the lower end thereof to permit water to drain from the interior compartment 46 should water somehow enter the interior compartment 46. Likewise, the second body portion 16 preferably has a plurality of drain openings 56 formed therein at the lower end thereof to permit water to drain from the interior compartment should water somehow enter the interior compartment 46. Preferably, each of the body portions 14 and 16 have structure formed therein to create a handle 58 when the body portions 14 and 16 are jointed together.

The numeral 60 refers to a rechargeable battery which is positioned in compartment 46. Battery 60 has a recharge cord 62 connected thereto which extends to a recharge port 64 which is selectively closed by a cap 66. Battery 60 is electrically connected to a motor 68 mounted in interior compartment 46. Motor 68 is connected to an exhaust fan or blower 70 which is mounted in interior compartment 46. Blower 70 has an air intake end 72 and an air discharge end 74. Air discharge end 74 has a shroud 76 extending therefrom towards the forward end of the device.

The numeral 78 refers to a vertically movable on/off push switch which is electrically connected to the motor 68 and/or battery 60. When push switch 78 is moved downwardly, the motor 68 will either be activated or deactivated. The upper end of the on/off push switch 78 is positioned above the upper end of the body 12. An air intake grill 80 is secured to the body portions 14 and 16 to cover the cut-outs 28 and 40. Grill 80 includes a downwardly extending lip or flange 82 which is received in the U-shaped channels 30 and 42 of body portions 14 and 16 respectively to extend between the cut-out portions 28 and 40. As seen, the upper end of on/off switch 78 protrudes upwardly through an opening 84 in grill 80.

The numeral 86 refers to an air discharge nose cone which is selectively rotatably secured to the forward ends of the body portions 14 and 16. The exterior of nose cone 86 has a plurality of fins 87 extending therefrom. The rearward end of nose cone 86 has a lip 88 which is rotatably mounted in the U-shaped channels 26 and 38 of body portions 14 and 16 respectively. Nose cone 86 has an air discharge opening 90 formed therein which is disposed at an angle to the longitudinal axis of the device 10.

The device 10 is operated as will now be described. A length adjustable extension pole 92 is threadably connected to the pole connector 52. The length of the extension pole is then adjusted to the desired length. The operator may then optionally depress the on/off switch 78 to activate the motor 68. However, the operator will usually not activate the motor 68 at this time but will wait until the device 10 has been elevated to the gutter 94. The operator may then position the device 10 below the gutter 94 and then move the device upwardly so that the switch 78 moves into engagement with the underside of the gutter 94 to depress switch 78 to activate the motor 68.

Figure 7:
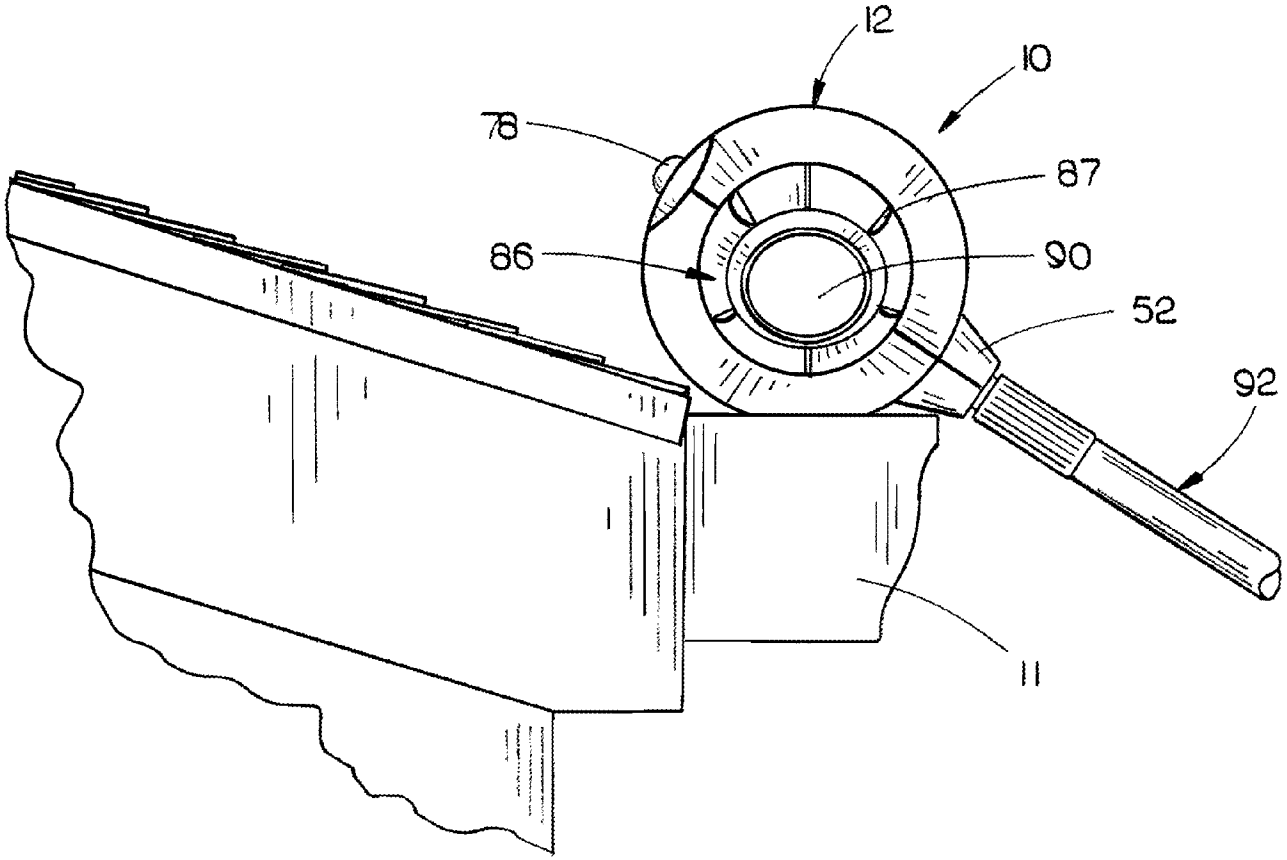
FIG. 7 is an end view illustrating the air blower device of this invention being used to clean a rain gutter.

The device 10 is then maneuvered so that the underside of the body 12 rests upon the upper end of the gutter 94 as seen in FIG. 7. The nose cone 86 is then rotated to the proper position so that the air discharge opening 90 is properly oriented with respect to the gutter 94 so that the air being discharged therefrom will blow the debris from the gutter 94. The selective rotation of the nose cone 86 is achieved by moving the device 10 laterally so that one of the fins 87 engages the gutter 94. Continued lateral movement of the device 10 causes the nose cone 86 to be rotated to the desired position.

The device 10 is then moved along the length of the gutter 94. The shape of the underside of the body 12 serves to slidably maintain the device 10 on the upper end of gutter 94. The shape of the device 10 enables the device to pass over the hanger brackets of the gutter.

The fact that the nose cone 86 may be rotated with respect to the body 12 enables the device 10 to be moved in a left-to-right manner and a right-to-left manner along the length of the rain gutter. If the nose cone 86 could not be rotated, the attitude of the air discharge opening 90 could not be changed which would limit the movement of the device 10 to a single direction. The nose cone 86 may be rotated so that the air discharge nozzle discharges air directly along the length of the rain gutter 94.

The device 10 may also be used to clean other elevated surfaces. The device 10 may also be used as a hand-held blower due to the device 10 having the handle 58 thereon.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A rain gutter cleaning apparatus, comprising:

an elongated pole having a first lower handle end and a second upper end;

an air blower secured to said second upper end of said pole;

said air blower having a forward end, a rearward end, an upper end and a lower end;

said air blower being powered by a battery driven motor positioned therein so that all of the components of the air blower are positioned at said second upper end of said pole;

said blower having an ovoid-like configuration;

said blower including a body having forward and rearward ends;

said body having a longitudinal axis;

a nose cone selectively rotatably secured to said body at said forward end thereof;

said nose cone having an air discharge opening formed therein which is disposed at an angle to the longitudinal axis of said blower whereby said air blower may be maneuvered by an operator grasping said first lower handle end so that the air flow from said air flow discharge nozzle may be directed into the rain gutter being cleaned to blow debris from the rain gutter;

said nose cone being selectively rotatably movable with respect to said body so as to enable the air blower to be moved in a left-to-right manner or a right-to-left manner with respect to the rain gutter;

said nose cone having a plurality of spaced-apart fins secured thereto which extend therefrom; and said nose cone being selectively rotatable by moving said air blower laterally with respect to the rain gutter whereby one of said fins engage the rain gutter with continued lateral movement of the air blower causing said nose cone to be rotated to the desired position.

2. The rain gutter cleaning apparatus of claim 1 wherein said pole is length extendable.

3. The rain gutter cleaning apparatus of claim 1 wherein said air blower is selectively secured to said second upper end of said pole.

4. The rain gutter cleaning apparatus of claim 1 wherein said second upper end of said pole is threadably secured to said air blower.

5. The rain gutter cleaning apparatus of claim 1 wherein said air blower includes a carrying handle.

6. The rain gutter cleaning apparatus of claim 1 wherein said body has an upper end and a lower end and wherein said upper end of said body has an air intake grill positioned thereon.

7. The rain gutter cleaning apparatus of claim 6 wherein said lower end of said body has a water drain opening formed therein.

8. The rain gutter cleaning apparatus of claim 6 wherein a vertically movable push switch extends upwardly from said upper end of said body, said push switch being operatively connected to said motor for energizing said motor and for deactivating said motor.

* * * * *